US006454590B1

(12) United States Patent
Goodrich et al.

(10) Patent No.: US 6,454,590 B1
(45) Date of Patent: Sep. 24, 2002

(54) POSITIVE CONNECTION SYSTEM FOR HIGH FREQUENCY COMMUNICATION CONNECTORS

(75) Inventors: Robert Ray Goodrich, Indianapolis; David L. Reed, Fountaintown; Ted E. Steele, Greenfield; Paul J. Straub, Jr., Mooresville, all of IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/918,176

(22) Filed: Jul. 30, 2001

Related U.S. Application Data

(60) Provisional application No. 60/278,526, filed on Mar. 23, 2001.

(51) Int. Cl.[7] ..... H01R 13/627

(52) U.S. Cl. ..... 439/357; 439/670

(58) Field of Search ..... 439/357, 358, 439/676, 152, 153, 155, 159, 352, 923, 354, 353, 941, 344

(56) References Cited

U.S. PATENT DOCUMENTS 4,526,431 A * 7/1985 Kasukawa ..... 439/153
6,224,427 B1 5/2001 Goodrich ..... 439/676

* cited by examiner

*Primary Examiner*—P. Austin Bradley
*Assistant Examiner*—Ross Gushi

(57) ABSTRACT

A connection system for communication connectors. A first connector housing forms a front opening having an axis for receiving a second connector having a latch in the direction of the axis. The first connector housing has a retaining surface in the region of the front opening for cooperating with a part of the latch and defining a connected position for the second connector within the first connector housing. At least two resilient fingers project from a rear portion of the first connector housing toward the front opening, symmetrically with respect to the axis of the opening. Free ends of the fingers urge the second connector toward the connected position and restrain the second connector from deviating from the connected position during use. Optimal electrical performance of the mated connectors can then be maintained.

19 Claims, 8 Drawing Sheets

POSITIVE CONNECTION SYSTEM FOR HIGH FREQUENCY COMMUNICATION CONNECTORS

CROSS REFERENCE TO RELATED APPLICATION

This application claims priority under 35 U.S.C §119(e) of U.S. Provisional Application No. 60/278,526 filed Mar. 23, 2001, and entitled "High Frequency Communication Connector With Controlled Variation In Electrical Performance".

BACKGROUND OF THE INVENTION

1. Field of the Invention

This invention relates to mechanisms for securing mated connectors to one another.

2. Discussion of the Known Art

When connecting high bandwidth communication plugs and jacks to one another, it is important that the configuration of the mated plug and jack relative to one another remain constant and not deviate during use. For example, a relatively minor displacement of the plug inside of the jack housing can significantly affect the overall electrical performance of the mated connectors.

In particular, if the jack includes components or devices for accomplishing capacitive and/or inductive crosstalk compensation among pairs of contact wires inside the jack housing, slight variations from an assumed mated configuration will defeat the crosstalk compensation incorporated into the connector system. To enable a modular communication plug to connect positively or "latch" properly within the housing of a modular communication jack, some overtravel is necessary to provide clearance for operation of a retaining latch or finger that protrudes from the plug, and to accommodate physical and dimensional tolerances of both connectors. For typical communication plugs and jacks, this clearance is about 0.033 inches and it creates a range of uncertainty with respect to the relative positions of the plug and the jack once they are connected electrically to one another. That is, the position at which contact blades exposed at the front of the plug make electrical contact with corresponding wires inside the jack housing, may vary by as much as 0.033 inches during service.

U.S. Pat. No. 6,224,427 (May 1, 2001) discloses a modular jack having a plug-positioning member. In one embodiment, the positioning member includes a cam inside of the jack housing, wherein the cam is configured to urge the plug toward a fixed or "back-latched" position at which a part of the plug latch contacts a forward retaining surface inside the jack housing.

Repeatability of the dimensions of the mated plug/jack configuration is more important than the final connected configuration itself. That is, once connected to the jack, it is less important whether the plug is in the full "back-latched" position, or in a full forward or "in-latched" position, as long as the connected plug/jack configuration remains steady and consistent over the service life of the connectors. See also commonly owned co-pending U.S. patent application Ser. No. 09/664,814 filed Sep. 19, 2000, entitled "Low Crosstalk Communication Connector".

SUMMARY OF THE INVENTION

According to the invention, a connection system for communication connectors includes a first connector housing that forms a front opening having an axis, for receiving a second connector including a latch along the direction of the axis. The first connector housing also has a retaining surface in the region of the front opening, wherein the retaining surface cooperates with part of the latch of the second connector to define a connected position at which the second connector is restrained from displacement out of the first connector housing. Two resilient fingers are fixed to a rear portion of the first connector housing, and project toward the front opening symmetrically with respect to the axis of the front opening. Free ends of the fingers are configured to urge the second connector toward the connected position and to restrain the second connector from displacement further into the first connector housing.

According to another aspect of the invention, a connection system for communication connectors includes a first connector housing that forms a front opening having an axis, for receiving a second connector including a latch along the direction of the axis. The first connector housing has a retaining surface in the region of the front opening, which surface cooperates with part of the latch of the second connector to define a connected position at which the second connector is restrained from displacement out of the first connector housing. A terminal housing is fixed to a rear portion of the first connector housing and has two resilient catches configured to engage sides of the first connector housing. The catches project toward the front opening of the first connector housing and have free ends formed to cooperate with a nose part of the second connector to urge the second connector toward the connected position, and to restrain the second connector from displacement further into the first connector housing.

For a better understanding of the invention, reference is made to the following description taken in conjunction with the accompanying drawing and the appended claims.

DETAILED DESCRIPTION OF THE INVENTION

Figure 1:
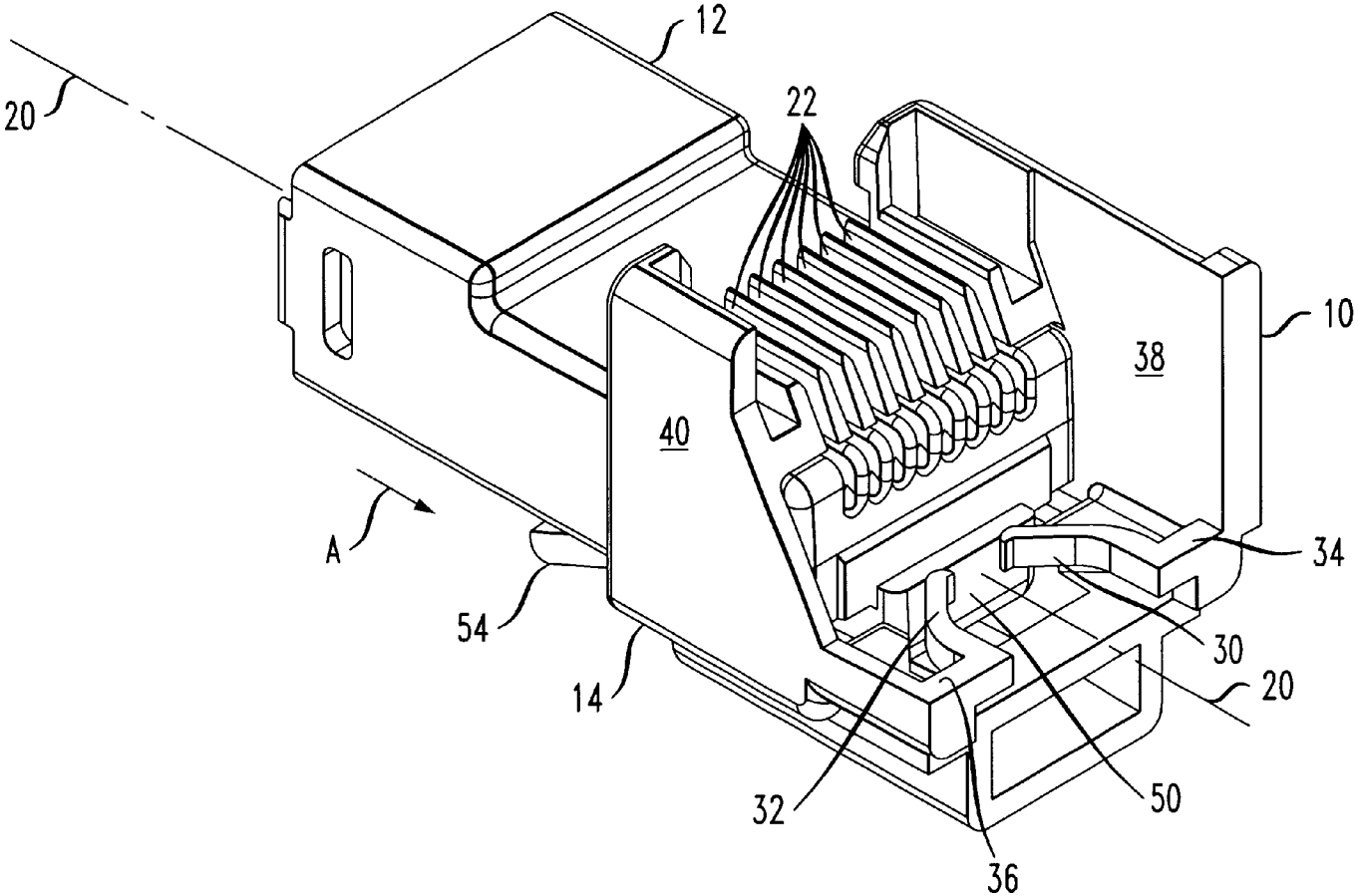
FIG. 1 is a perspective view of a housing of a modular communication jack as seen from the rear, and with parts broken away to show a first embodiment of the invention in relation to a mating plug.
Figure 2:
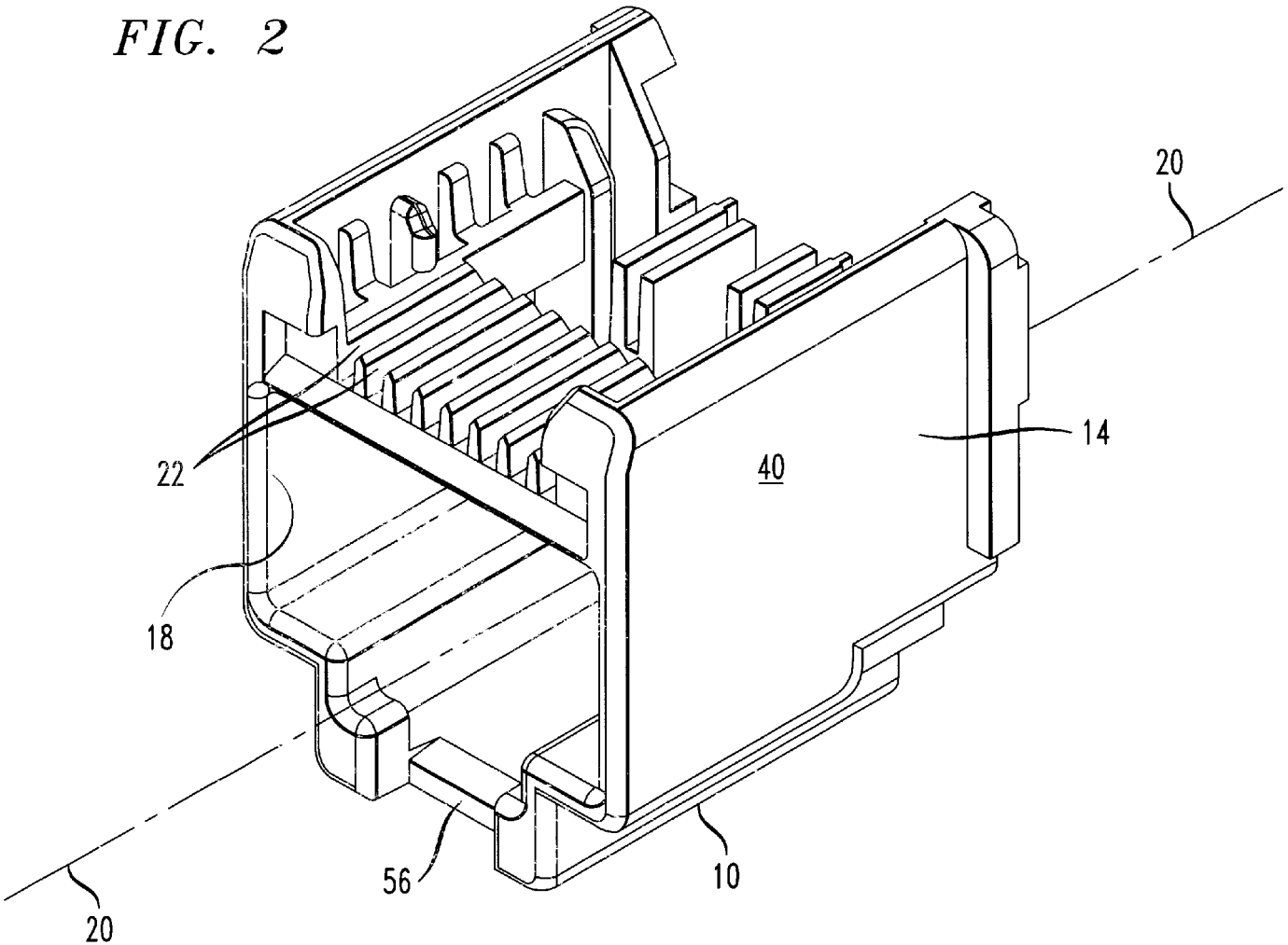
FIG. 2 is a perspective view of the jack housing in FIG. 1 as seen from the front.

FIG. 1 is a perspective view of a jack housing 10 of a modular communication jack according to the invention, as seen from the rear. FIG. 2 is a perspective view of the jack housing 10 as seen from the front. In FIG. 1, a mating plug 12 is being inserted into the jack housing 10 along the direction of arrow A.

As seen in FIG. 2, the jack housing 10 forms a front opening 18 for receiving the plug 12 (FIG. 1). The opening 18 has an axis 20, and the direction A in which the plug is inserted is parallel to the axis 20 of the front opening. While not shown in the drawing, a number, e.g., eight, contact wires are supported within corresponding, equi-spaced vertical channels 22 that are formed in an upper front portion of the jack housing 10. Each channel 22 extends in length in the direction of the axis 20 of the front opening 18. A cover (not shown) is constructed and arranged to extend over the top and the rear of the jack housing 10, for protectively enclosing the contact wires and any other components or devices associated with the wires. For example, a printed wiring board may be seated between the cover and the contact wires for introducing a first stage of crosstalk compensation. See commonly owned co-pending application Ser No. 09/887,147 filed Jun. 22, 2001, for "Inductive Crosstalk Compensation in a Communication Connector", which is incorporated by reference. The jack housing 10 may be molded or otherwise formed of any suitable dielectric or insulative material such as, for example, polycarbonate, ABS, or blends thereof, to meet all applicable standards with respect to electrical insulation and flammability.

A pair of resilient fingers 30, 32 are fixed at their bases to a rear portion of the jack housing 10, as seen in FIG. 1. The bases of the fingers 30, 32 are joined to corresponding ledges 34, 36 that project inward from side walls 38, 40 of the jack housing 10. The fingers 30, 32 together with the ledges 34, 36 may be formed integrally with the housing 10. The fingers 30, 32 extend toward the front opening 18 of the jack housing 10, at either side of and symmetrically with respect to the axis 20 of front opening 18. In the illustrated embodiment, the fingers 30, 32 are supported in a common plane that is substantially parallel to the axis 20 of the front opening.

Figure 3:
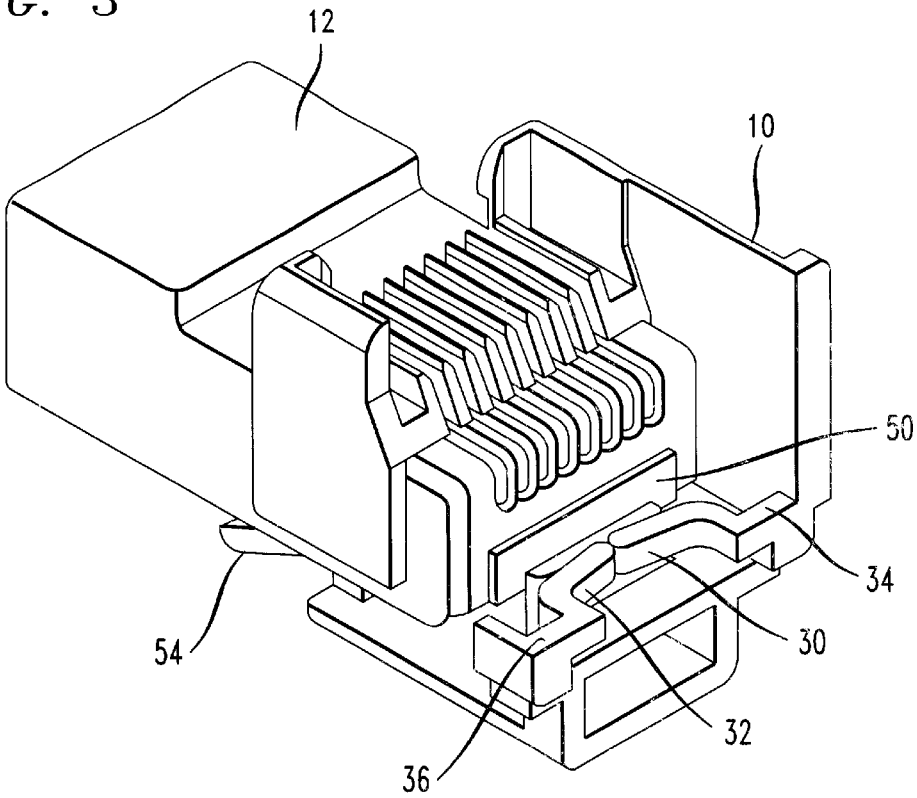
FIG. 3 is a perspective view similar to FIG. 1, with the plug in a fully inserted position inside the jack housing.
Figure 4:
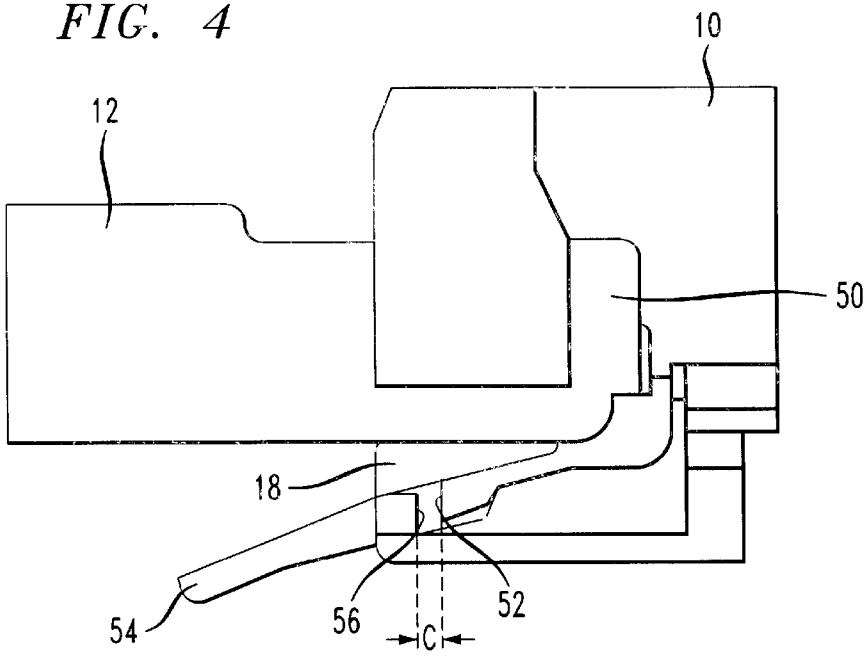
FIG. 4 is a side view of the plug fully inserted in the jack housing as in FIG. 3.

Also, in the present embodiment, free ends of the resilient fingers 30, 32, are configured to arc toward one another, and to confront a nose part 50 of the plug 12 as the plug is inserted through the housing front opening 18, as shown in FIG. 1. As the plug 12 continues to advance forward within the jack housing 10, the free ends of the fingers 30, 32 deflect toward one another to a position at which the free ends abut, as seen in FIG. 3. At the position in FIG. 3, the fingers 30, 32 act to stop the plug 12 from advancing further into the jack housing 10, and define a so-called "in-latched" position representing a limit of the mentioned overtravel or clearance of 0.033 inches for typical modular communication jacks and plugs. As seen in FIG. 4, such clearance is needed to ensure that a catch surface 52 on a plug latch 54 associated with the plug 12, will ride over and clear a forward retaining bar 56 formed on the housing 10 beneath the entrance of the front opening 18.

Figure 5:
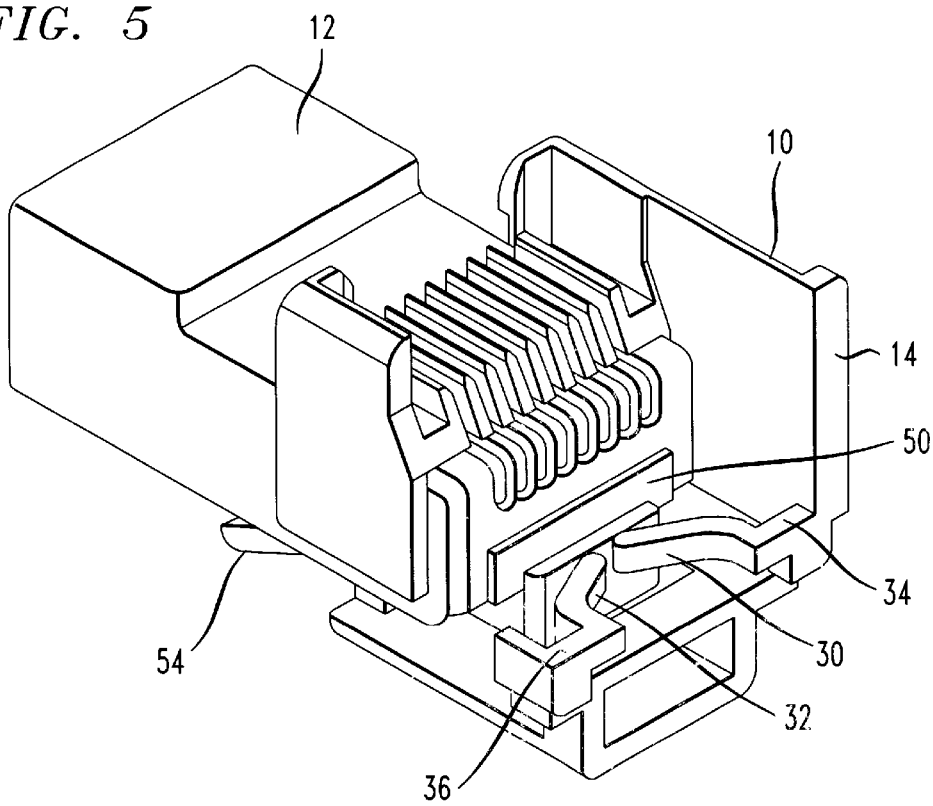
FIG. 5 is a perspective view similar to FIG. 1, with the plug urged toward and restrained at a connected position with respect to the jack housing.
Figure 6:
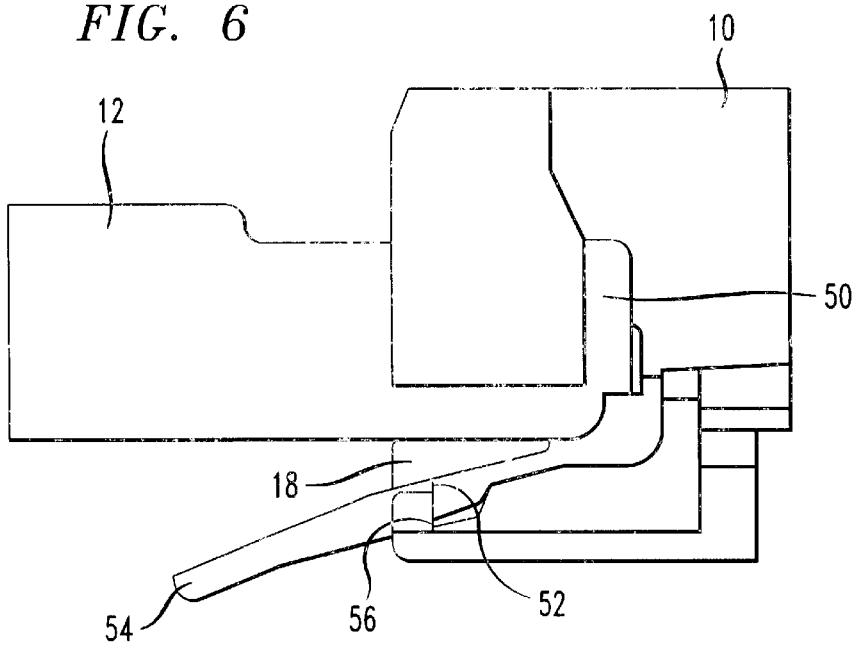
FIG. 6 is a side view of the plug at the connected position in the jack housing, as in FIG. 5.

Once the plug 12 is advanced to the in-latched position of FIGS. 3 and 4 and the plug is released, the resilient fingers 30, 32 within the jack housing urge the plug 12 toward a "back-latched" position, shown in FIGS. 5 and 6. At this position, the catch surface 52 of the plug latch 54 is urged to contact an inside surface of the retaining bar 56 on the jack housing, thus defining a predetermined, repeatable connected position for the plug 12 within the jack housing 10. Optimum electrical performance of the mated connectors will then be maintained.

Figure 7:
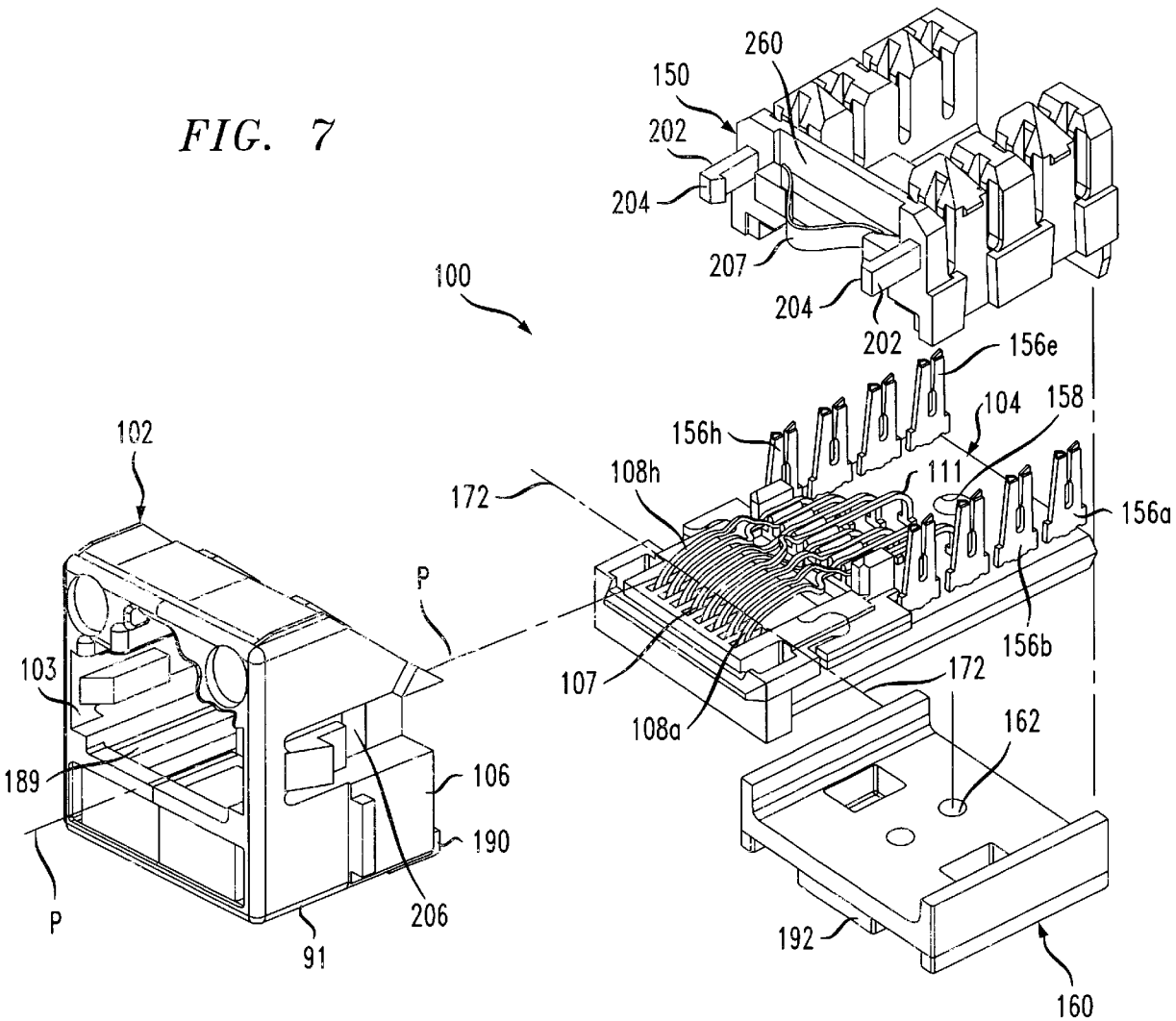
FIG. 7 is an assembly view of a modular communication jack according to a second embodiment of the invention.

FIG. 7 is an assembly view of a modular communication jack 100 according to a second embodiment of the invention. The jack 100 includes a jack housing 102 having a front face in which a plug opening 103 is formed, and a rear wall 106. The plug opening 103 has an axis P along the direction of which a mating modular plug 101 (see FIGS. 8–13) is insertable into the jack housing. The jack 100 also includes a printed wiring board 104. For example, the board 104 may comprise a single or a multi-layer dielectric substrate.

A number of elongated terminal contact wires 108*a*–108*h* extend over and generally parallel to a top surface of the wiring board 104. Connecting portions 107 of the contact wires may be spaced uniformly above a front portion of the wiring board at a determined height, e.g., 0.090 inches.

The connecting portions 107 of the contact wires are formed to deflect resiliently in the direction of the wiring board 104, when blade terminals 109 of the mating plug 101 (see FIG. 8) wipe over the connecting portions 107 in the direction of the axis P of the plug opening 13. The contact wires 108*a*–108*h* may be formed of a copper alloy such as spring-tempered phosphor bronze, beryllium copper or the like. A typical cross-section of the contact wires is about 0.015 inch wide by about 0.010 inch thick.

The contact wires 108*a*–108*h* have associated base portions 111 that are formed to connect a contact wire to one or more conductors (not shown) on or within the wiring board 104. For example, the base portions of the contact wires may be soldered or press-fit in plated terminal openings formed in the board, to connect with corresponding conductive paths or on within the board. Also, the wiring board 104 may incorporate electrical circuit components or devices (not shown) selected to compensate for crosstalk introduced by the mating plug 101. See, for example, U.S. Pat. No. 5,997,358 (Dec. 7, 1999), all relevant portions of which are incorporated by reference.

An electrically insulative, dielectric terminal housing 150 covers a rear portion of the top surface of the wiring board 104. Outside insulated wire leads (not shown) may be connected to insulation displacement connector (IDC) terminals 156*a* to 156*h* that are mounted on the board, wherein the IDC terminals are partly surrounded and supported by terminal guards of the housing 150. The terminal housing 150 is formed of a plastics or other insulative material that meets all applicable standards with respect to electrical insulation and flammability. Such materials include but are not limited to polycarbonate, ABS, and blends thereof. The terminal housing 150 has at least one fastening or mounting post (not shown) that projects from below the housing as viewed in FIG. 7, to pass through one or more openings 158 formed in the board 104.

The IDC terminals 156*a*–156*h* are mounted along both sides of a rear portion of the wiring board 104 as viewed in FIG. 7. Each of the IDC terminals 156*a*–156*h* has a mounting portion that is soldered or press fit in a corresponding terminal mounting hole in the board, to connect via a conductive path with an associated one of the terminal contact wires 108*a*–108*h*. During assembly, the terminal housing 150 is aligned over the IDC terminals 156*a*–156*h*, and then lowered to receive the IDC terminals in corresponding slots in the terminal guards while the fastening post(s) beneath the housing 150 descend through the opening(s) 158 in the wiring board 104.

A cover 160 which is formed of the same or a similar material as the terminal housing 150, is arranged to protect the bottom rear portion of the wiring board 104 as viewed in FIG. 7. The cover 160 has one or more openings 162 for receiving a tip of a fastening post of the terminal housing 150. The rear portion of the wiring board 104 is thus captured and secured between the terminal housing 150 and the cover 160, for example, upon ultrasonic welding of the tip of the fastening post of the terminal housing 150 to a region of the cover 160 surrounding the cover opening 162. See U.S. Pat. No. 5,924,896 (Jul. 20, 1999), all relevant portions of which are incorporated by reference.

As mentioned, the connecting portions 107 of the contact wires 108*a*–108*h* on the wiring board 104 are formed to make electrical contact with corresponding blade terminals 109 of the mating plug 101. A line of contact 172 (see FIG. 7) is defined transversely of the contact wires, along which line electrical contact is established between the contact wires in the jack 100 and the blade terminals 109 of the mating plug 101.

During assembly of the jack 100, the wiring board 104 is inserted in a passage 189 that opens in the rear wall 106 of the jack housing 102. Side edges of the board 104 are guided for entry into the housing 102 by, e.g., ledges that project from inside walls of the jack housing 102. The jack housing also has a slotted catch bar 190 that protrudes rearward from below the housing as viewed in FIG. 7. The bar 190 is dimensioned to capture a lip 192 on a forward edge of the wire board cover 160. Once the wiring board 104 is assembled in the jack housing 102, the top surface of the board is substantially parallel to the axis P of the plug opening 103.

Two resilient side catches 202 project forward from both sides of the terminal housing 150, as viewed in FIG. 7. The catches may be molded or otherwise formed integrally with the housing 150. The catches 202 have mutually facing hook-shaped ends 204 that snap into and lock within recesses 206 formed in both side walls of the jack housing 102. Thus, all adjoining parts of the jack 100 are positively attached to one another to reduce relative movement between them, and to help maintain rated connector performance by reducing variation in the relative positions of the various connector parts once assembled.

Figure 8:
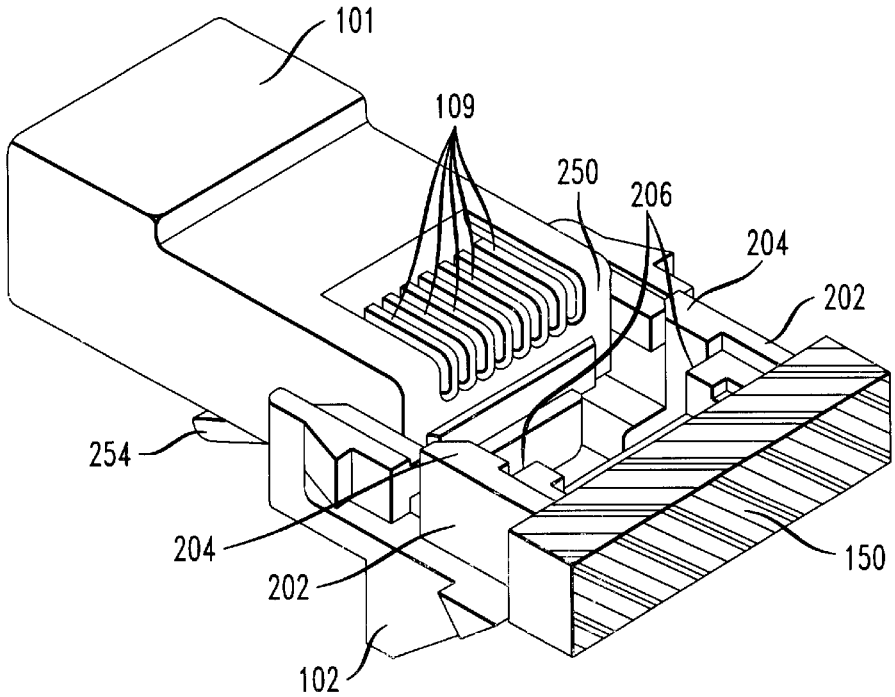
FIG. 8 is a perspective view of the jack in FIG. 7 as seen from the rear, and with parts broken away to show a mating plug.
Figure 9:
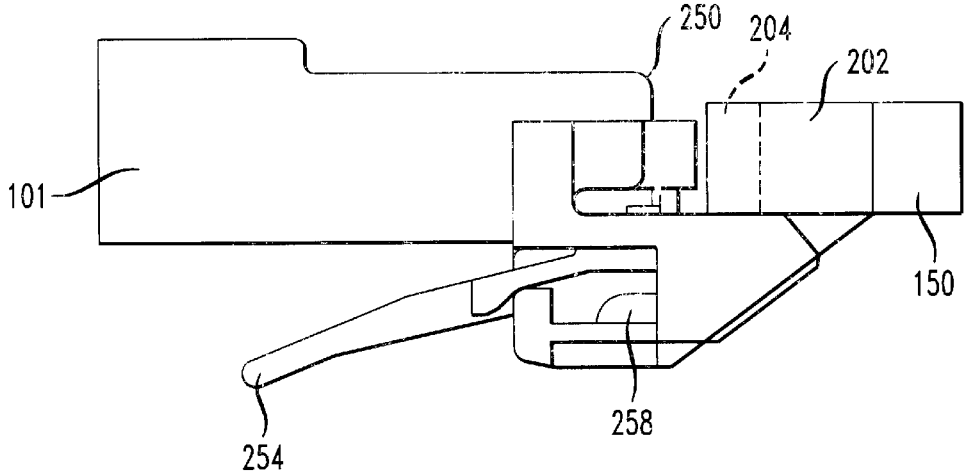
FIG. 9 is a side view of the plug being inserted in the jack as in FIG. 8.

FIG. 8 is a perspective view of a front portion of the jack housing 102 as seen from behind, with parts broken away to show the plug 101 as it enters the housing 102. FIG. 9 is a side view of the plug 101 being inserted in the jack housing, as in FIG. 8. Also shown in FIGS. 8 and 9 is a front portion of the terminal housing 150 joined to the jack housing 102 by way of the side catches 202. In FIGS. 8–13, the orientation of the jack housing 102 and the terminal housing 150 is inverted with respect to FIG. 7.

Figure 10:
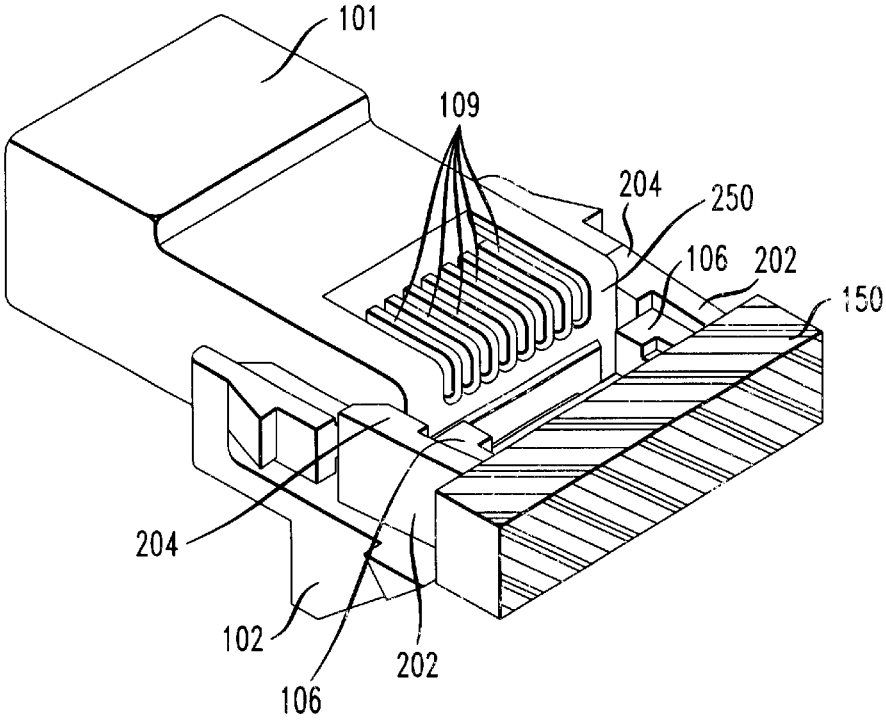
FIG. 10 is a perspective view similar to FIG. 8, with the plug in a fully inserted position inside the jack.
Figure 11:
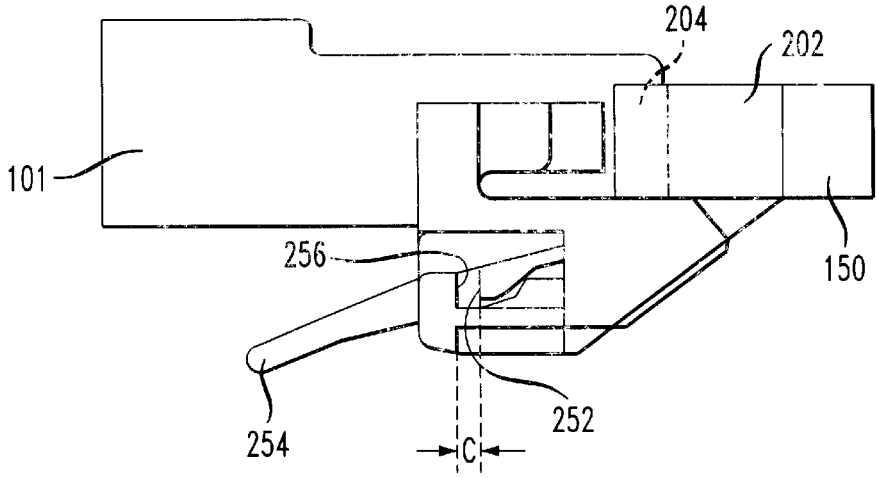
FIG. 11 is a side view of the plug fully inserted in the jack as in FIG. 10.

A nose part 250 of the plug 101 has sides edges that confront inclined surfaces of the hooked ends 204 on the side catches 202. Therefore, as the plug 101 continues to advance into the jack housing 102, the side catches 202 are urged by the plug 101 to deflect outwardly or away from one another as seen in FIG. 10. Further advancement of the plug 101 is then blocked by the rear wall 106 of the jack housing 102. The position of the plug 101 in FIGS. 10 and 11 thus corresponds to an "in-latched" position representing the earlier mentioned overtravel or clearance of typically 0.033 inches. As seen in FIG. 11, such clearance is required to ensure that a catch surface 252 of a finger latch 254 associated with the plug 101, will ride over and clear an inside retaining surface 256 of the jack housing 102 beneath the entrance of the plug opening 103. When in the in-latched position, the side edges of the plug nose part 250 remain positioned on the inclined surfaces of the hooked ends 204 of the terminal housing side catches 202, and the hooked ends continue to engage the jack housing via the side wall recesses.

Figure 12:
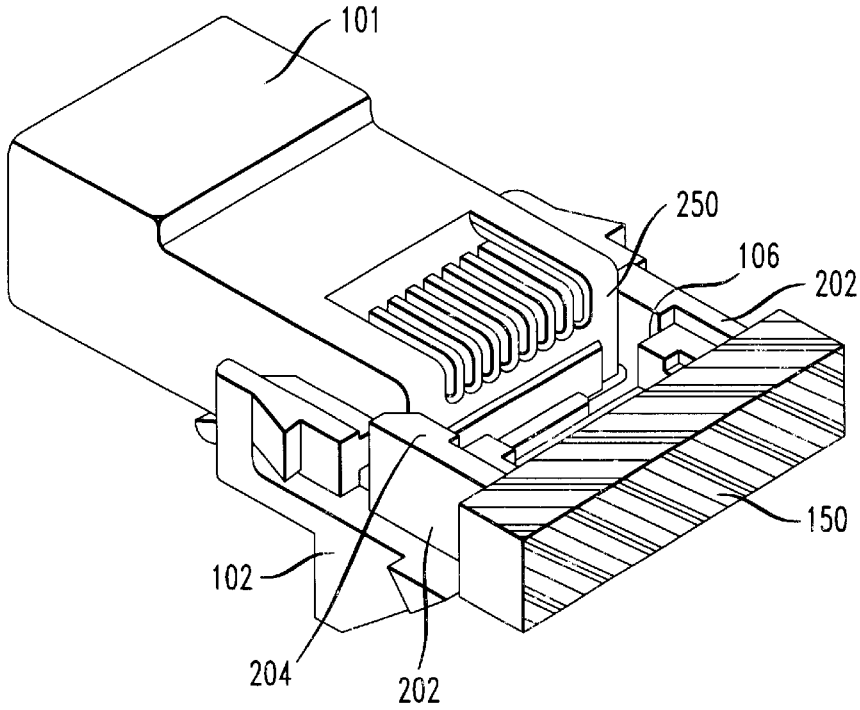
FIG. 12 is a perspective view similar to FIG. 8, with the plug urged toward and restrained at a connected position.
Figure 13:
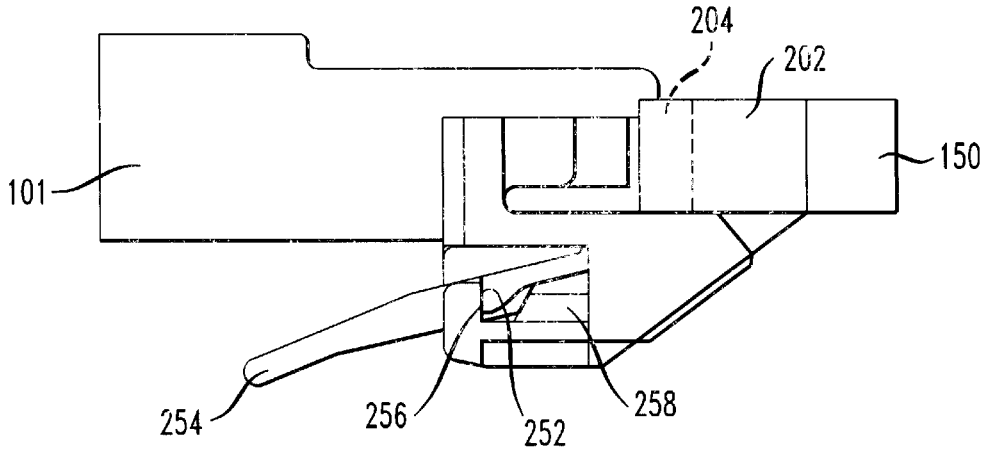
FIG. 13 is a side view of the plug at the connected position in the jack, as in FIG. 12.

Once the plug 101 is inserted as far as the in-latched position of FIGS. 10 and 11 and the plug is released, the inclined surfaces of the hooked ends 204 on the catches 202 will act to urge the plug toward the back-latched position shown in FIGS. 12 and 13. At this position, the catch surface 252 of the plug latch 254 is urged flush against the inside retaining surface 256 on the jack housing, thus defining a predetermined repeatable connected position for the plug 101 within the jack housing 102. Optimum electrical performance of the mated connectors will then be maintained.

While the foregoing description represents preferred embodiments of the invention, it will be obvious to those skilled in the art that various changes and modifications may be made without departing from the spirit and scope of the invention pointed out by the following claims. For example, in addition to the resilient fingers 30, 32 or the side catches 202, the jack. housing 10 (or 102) may also have a resilient, inclined wedge piece or cam 258 located on an inside surface of the housing as disclosed in U.S. Pat. No. 6,224,427, so as to confront the plug latch 54 (or 254) and urge the plug 12 (or 101) to the predetermined connected position (see FIG. 13). Further, the terminal housing 150 in the embodiment of FIGS. 7–13 may also have a unitary resilient leaf spring 207, similar to the one disclosed in the '427 patent, disposed on a front wall 260 of the housing 150 and above the wiring board 104 as viewed in FIG. 7. The leaf spring may then confront the nose part 250 of the plug 101 and urge the plug toward the connected position. The use of such redundant means for positioning the plug 12 or 101 when mated within the corresponding jack housing, will further ensure that the desired connected position for the plug will be achieved on a consistent basis during the service life of the connectors.

We claim:

1. A connection system for communication connectors, comprising:

a first connector housing forming a front opening having an axis, for receiving a second connector including a latch along the direction of said axis;

the first connector housing forms a retaining surface in the region of the front opening, wherein the retaining surface defines a connected position at which the retaining surface cooperates with a part of the latch to restrain displacement of the second connector in a direction out of the first connector housing; and a terminal housing joined to the first connector housing, the terminal housing having two resilient catches which are formed to project from opposite sides of the terminal housing and to engage corresponding sides of the first connector housing;

wherein said catches project toward the front opening of the first connector housing, and free ends of the catches are configured to cooperate with a nose part of the second connector to urge the second connector toward the connected position and to restrain the second connector from displacement further into the connector housing.

2. A connection system according to claim 1, wherein said catches extend generally in a common plane.

3. A connection system according to claim 2, wherein the common plane is substantially parallel to the axis of the front opening of the first connector housing.

4. A connection system according to claim 1, wherein said catches include hook-shaped free ends having inclined surfaces configured to confront the nose part of the second connector when the second connector is received in the front opening of the first connector housing.

5. A connection system according to claim 4, wherein said catches are dimensioned and arranged to deflect away from one another in response to advancement of the nose part of the second connector through said front opening, and the first connector housing includes a rear wall that defines a limit of travel of the second connector beyond the connected position inside the first connector housing.

6. A connection system according to claim 5, wherein the limit of travel is about 0.033 inches.

7. A connection system according to claim 1, wherein the first connector housing is a jack housing of a modular communication jack.

8. A connection system according to claim 1, wherein the first connector housing includes a resilient, inclined wedge piece or cam on an inside surface of the housing and located to confront a part of the second connector to urge the second connector toward the connected position.

9. A connection system according to claim 8, wherein the first connector housing is a jack housing of a modular communication jack.

10. A connection system according to claim 1, wherein the terminal housing has a front wall, and including a unitary resilient leaf spring disposed on the front wall to confront a part of the second connector to urge the second connector toward the connected position.

11. A connection system according to claim 10, wherein the first connector housing is a jack housing of a modular communication jack.

12. A connection system for communication connectors, comprising:

a first connector housing forming a front opening having an axis, for receiving a second connector including a latch along the direction of said axis;

the first connector housing forms a retaining surface in the region of the front opening, wherein the retaining surface defines a connected position at which the retaining surface cooperates with a part of the latch to restrain displacement of the second connector in a direction out of the first connector housing; and at least two resilient fingers fixed to a rear portion of the first connector housing and arranged to project toward the front opening symmetrically with respect to the axis of the front opening, wherein free ends of the fingers are configured to urge the second connector toward the connected position and to restrain the second connector from displacement further into the connector housing;

free ends of said fingers are configured to arc toward one another to confront a part of the second connector when the second connector is received in the front opening of the first connector housing; and the free ends of the fingers are constructed and arranged to deflect toward and to abut one another in response to advancement of the second connector through said front opening, thus defining a limit of travel of the second connector beyond the connected position inside the first connector housing.

13. A connection system according to claim 12, wherein the limit of travel is about 0.033 inches.

14. A connection system for communication connectors, comprising:

a first connector housing forming a front opening having an axis, for receiving a second connector including a latch along the direction of said axis;

the first connector housing forms a retaining surface in the region of the front opening, wherein the retaining surface defines a connected position at which the retaining surface cooperates with a part of the latch to restrain displacement of the second connector in a direction out of the first connector housing; and at least two resilient fingers fixed to a rear portion of the first connector housing and arranged to project toward the front opening symmetrically with respect to the axis of the front opening, wherein free ends of the fingers are configured to urge the second connector toward the connected position and to restrain the second connector from displacement further into the connector housing;

wherein the first connector housing is a jack housing of a modular communication jack; and a number of equi-spaced parallel channels are formed in a portion of the jack housing to support associated contact wires for making electrical connections with corresponding contacts on a mating plug connector.

15. A connection system according to claim 14, wherein said fingers extend in a common plane.

16. A connection system according to claim 15, wherein the common plane is substantially parallel to the axis of the front opening of the first connector housing.

17. A connection system according to claim 14, wherein free ends of said fingers are configured to arc toward one another to confront a part of the second connector when the second connector is received in the front opening of the first connector housing.

18. A connection system according to claim 7, wherein the free ends of the fingers are constructed and arranged to deflect toward and to abut one another in response to advancement of the second connector through said front opening, thus defining a limit of travel of the second connector beyond the connected position inside the first connector housing.

19. A connection system according to claim 18, wherein the limit of travel is about 0.033 inches.

* * * * *